United States Patent [19]

Williams

[11] 4,006,556

[45] Feb. 8, 1977

[54] ILLUMINATED HULA HOOP

[76] Inventor: Mervin R. Williams, 305 E. Jackson Ave., Flint, Mich. 48505

[22] Filed: Aug. 11, 1975

[21] Appl. No.: 603,343

[52] U.S. Cl. ..... 46/228; 46/47
[51] Int. Cl.[2] ..... A63H 1/32; A63H 33/26
[58] Field of Search ..... 46/47, 228

[56] References Cited

UNITED STATES PATENTS

| | | | |
|---|---|---|---|
| 989,944 | 4/1911 | Bramson | 46/228 |
| 2,623,327 | 12/1952 | Testino | 46/228 |
| 3,079,728 | 3/1963 | Melin | 46/47 |

*Primary Examiner*—Hugh R. Chamblee
*Assistant Examiner*—Robert F. Cutting
*Attorney, Agent, or Firm*—Basile, Weintraub and VanOphem

[57] ABSTRACT

A hula hoop type toy is provided with a plurality of aesthetically configured openings disposed therearound. Light emitting means, such as light bulbs, provided in an electrical circuit are associated with the openings. The electrical circuit is powered by a battery and closed by a centrifugal switch and is disposed in the interior of the hoop.

6 Claims, 7 Drawing Figures

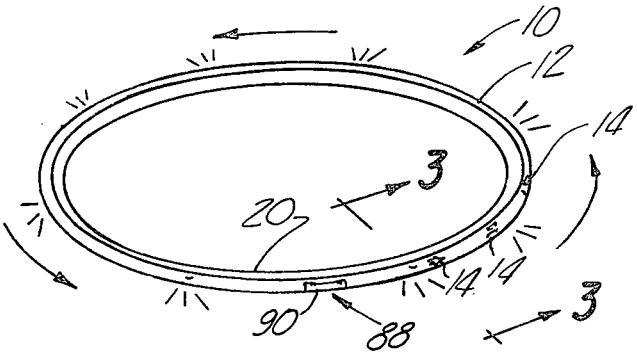
Fig-1
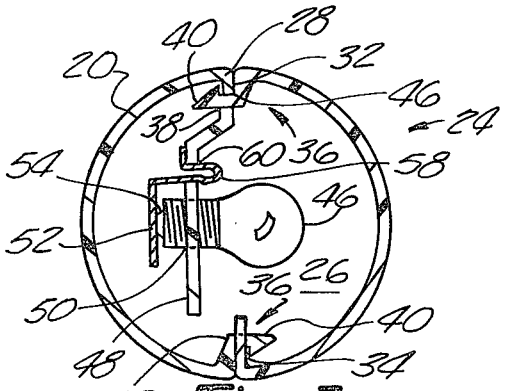
Fig-3
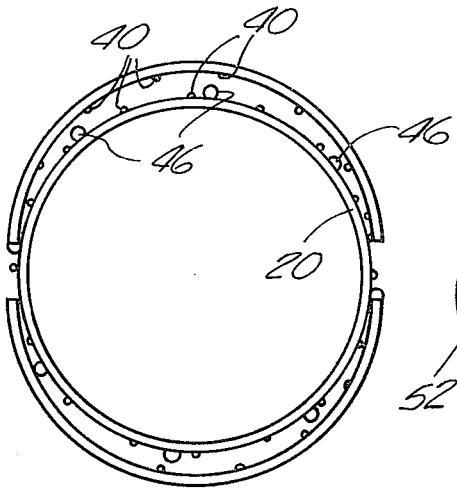
Fig-2
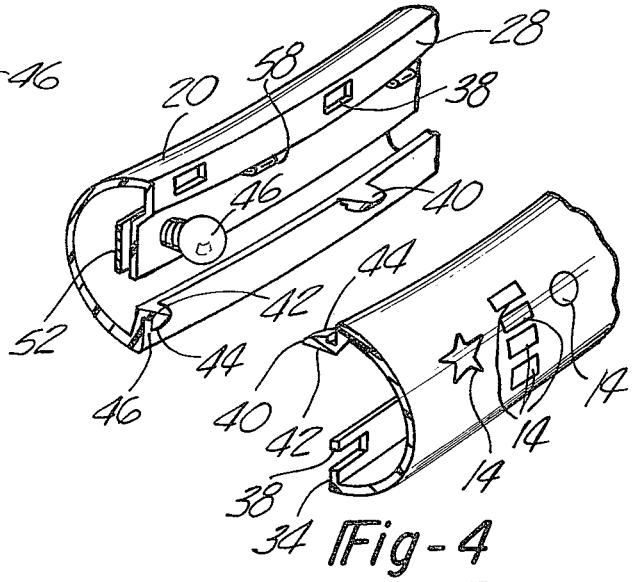
Fig-4
Fig-5
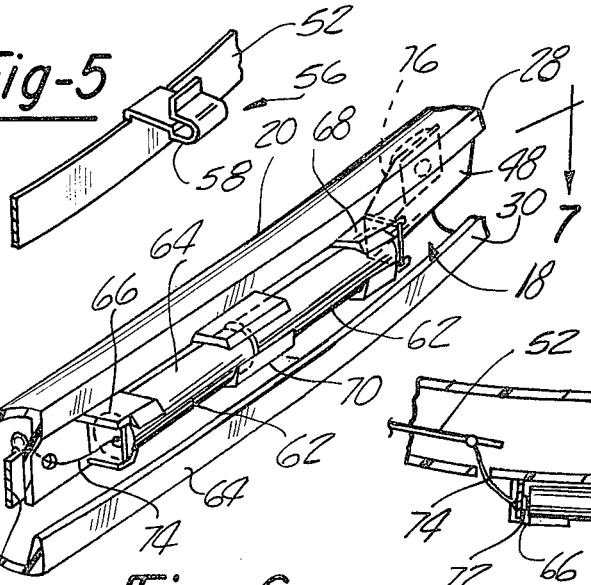
Fig-6
Fig-7
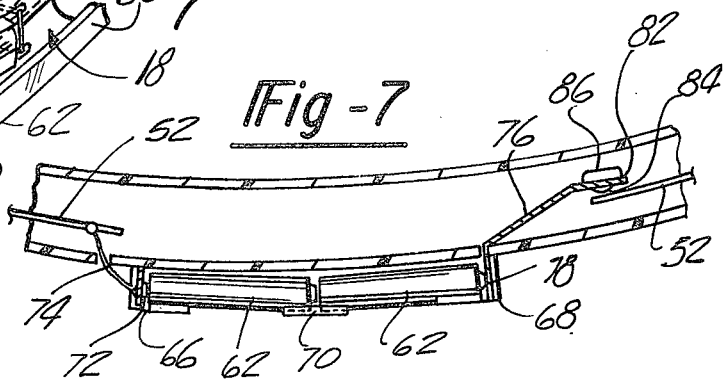

ILLUMINATED HULA HOOP

BACKGROUND OF THE INVENTION

1. Field of the Invention

The present invention pertains to toy devices. More particularly, the present invention pertains to hoop toys. Even more particularly, the present invention pertains to hoop toys having an illuminating effect associated therewith.

2. Prior Art

There has been taught heretofore a plurality of hoop toys which are adapted to be rotated about the user's waist. These toys are commonly referred to as "hula hoops." See, inter alia, U.S. Pat. No. 3,079,728.

The art has further taught means for rendering such toys more aesthetically appealing. Thus, there has been taught hoop toys having multi-colored sections. See, for example, U.S. Pat. No. 3,332,166. The art has, also, taught the incorporation of means to render such hoop toys expansible and contractable. See, for example, U.S. Pat. No. 3,729,860.

Heretofore, however, there has not been, to applicant's knowledge, a toy of the type under consideration, which has illumination means associated therewith. It is to this to which the present invention is directed.

SUMMARY OF THE INVENTION

In accordance with the present invention there is provided a hoop toy having illumination means associated therewith.

The hoop, per se, comprises a two-piece hollow annular conduit of lightweight construction and which is adapted to be rotatingly revolved around a user's body in response to movement of the body. The periphery of the hoop is provided with a plurality of openings. Associated with the openings are a plurality of light emitting means, such as light bulbs.

The light emitting means is in electrical communication with a power source and a normally open switch. The switch is adapted to be closed upon the rotation of the hoop thereby closing the circuit.

For a more complete understanding of the present invention, reference is made to the following detailed description and accompanying drawing. In the drawing, like reference characters refer to like parts throughout the several views in which:

BRIEF DESCRIPTION OF THE DRAWINGS

FIG. 1 is a perspective view of an assembled hula hoop in accordance with the present invention;

FIG. 2 is a top plan view of a partially disassembled hula hoop in accordance with the present invention;

FIG. 3 is a cross-sectional view taken along the line 3—3 of FIG. 1;

FIG. 4 is a broken, exploded perspective view of the interior of the present hula hoop about a light emitting means;

FIG. 5 is a broken perspective view of part of the electrical assembly of the present invention;

FIG. 6 is a broken, perspective view of the power supply employed in the practice of the present invention, and FIG. 7 is a sectional view taken along the line 7—7 of FIG. 6.

DESCRIPTION OF THE PREFERRED EMBODIMENT

Now, with reference to the drawing, there is depicted therein, a hula hoop toy in accordance with the present invention, and generally indicated at 10. The toy 10 is adapted to be placed about the user's body and to be rotated in response to body movement, as indicated by the arrows in FIG. 1, and in the well-known manner. The toy 10 is provided with generally toroidal configuration. Preferably, the toy is formed from a resilient plastic material such as an ABS resin, nylon, polypropylene and the like.

The toy 10 generally comprises a hoop member 12 having a plurality of apertures 14 circumferentially disposed about the exterior periphery thereof. The toy further comprises light emitting means, generally indicated at 16 and a power supply, generally indicated at 18. The power supply 18 energizes the light emitting means 16, in a manner to be described subsequently, and the emitted light is displayed to the environment through the apertures 14.

With more particularity the hoop member 12 comprises a pair of opposed arcuate or semi-cylindrical walls 20 and 22. The opposed walls 20, 22 cooperate to define a substantially thin-walled hollow conduit 24 having an open interior 26. For purposes of clarity, the wall 20 will be referred to as the inner wall and the wall 22 as the outer wall. Each wall 20, 22 is provided with diametrically opposed inwardly directed flanges 28, 30, 32 and 34, respectively. The surfaces of the opposed flanges abut one another as clearly shown in FIGS. 2 and 3. The opposed walls 20, 22 are interconnectable via complementary locking means 36 associated with the flanges.

The locking means 36 generally comprises cooperating apertures 38 and snap-in projections 40 provided on the flanges. As clearly shown in FIGS. 2 and 3, one of the flanges 28 of the inner wall 20 is provided with a plurality of apertures 38 circumferentially disposed therearound. A plurality of outward projections 40 are integrally formed with the flange 30. The flange 34 of the outer wall 22 which abuts the flange 30 is provided with a plurality of apertures 38 circumferentially disposed therearound. The flange 32 which abuts the flange 28 includes a plurality of outwardly directed projects 40. The projections 40 are dimensioned to snugly and tightly fit within the aperture 38 provided on the abutting flange surface. Thus, the opposed walls are interconnected by snapping the projections into the apertures of the abutting flange surface. By interconnecting the two opposed walls the hollow thin walled conduit 24 is thereby defined.

In FIGS. 2 and 3 there is depicted a preferred form of the projections 40. The projections comprise an elongated linear member 42 having a chamfered shoulder 44. A recess 46 is provided between the flange associated therewith and the edge of the shoulder 44. The recess is dimensioned to be substantially equal to the thickness of the flange, the aperture of which it is snapped into. By manufacturing the opposed walls from a rigid plastic, the projection will slide along the chamfered surface into the aperture and any resiliency accorded the plastic will cause the flange portion about the aperture to snap or seat in the recess. It is apparent, however, that other configurations of the complementary locking means are equally applicable herein.

As hereinbefore noted, the present invention includes light emitting means 16. The light emitting means generally comprises a plurality of light bulbs 46 circumferentially mounted about the hoop member 12 and which are disposed in the interior 26 thereof. Optimally, the light bulbs 46 are associated with the inner wall 20. The bulbs 46 are mounted in the interior via a support wall 48. The support wall 48 is a depending wall which is, preferably, integrally formed with one of the inner wall flanges 28 or 30. In the drawing, the support wall 48 is depicted as being integrally formed with the downwardly depending from the flange 28. The support wall 48 is provided with a plurality of apertures 50 circumferentially disposed therearound. The apertures 50 threadably or otherwise receive and sustain the light bulbs 46.

In order to achieve and maintain electrical communication between the power supply 18 and the light emitting means 16, a contact bar 52 is disposed in the interior 26 of the hoop member 12. The contact bar 52 comprises a strip of electrically conductive material, such as copper, which is adapted to be in contact with the contact 54 of the light bulb 46.

The contact bar 52 is supported and held in position within the interior by means 56. The means 56 comprises at least one clip 58 which is integrally formed with the bar 52 at the upper edge thereof. The clip 58 snaps into a clip-receiving notch 60 formed in the support wall 48, as shown in FIG. 2. Because of the resiliency of the clip, the clip remains tightly secure within the notch 60 and cannot be dislodged therefrom without manual pressure. Thus, the clip holds the contact bar 52 in position and in contact with the light bulb contact.

The light emitting means is energized by a power supply 18, as hereinbefore noted. The power supply 18 is depicted in FIGS. 6 and 7. The power supply 18 comprises a battery 62 or a pair of batteries 62 disposed within the interior 26 of the hoop member 12.

The power supply 18 is supported by a casing 64. The casing 64 is integrally formed with the support wall 48 and is formed from a resilient material. The casing 64 comprises a pair of end members 66 and 68, respectively, and a medial portion 70. The casing enshrouds the power supply to hold it in position. The resiliency afforded the casing permits the removal of the batteries when necessary.

The end member 66, which is defined as the negative end, has a contact 72 embedded therewithin. The contact 72 is adapted to be in contact with the negative terminal or pole of the battery 62. Extending from the contact 72 to the contact bar 52 is an electrical lead wire 74 as shown.

The other end member 68, which is defined as the positive end, has associated therewith, a normally open centrifugal switch 76. The centrifugal switch 76 is formed from a conductive material, such as copper, and has one end thereof 78 in contact with the positive terminal or pole 80 of the battery 62. The other end 82 of the switch 76 is in proximity to the contact bar 52. A contact 84 is mounted on the end 82 of the switch 76. Because the switch is formed to be normally open, a weight 86 is provided proximate the end 82 thereof. The weight maintains the contact between the contact 84 and the contact bar 52.

It is to be appreciated from the preceding that when the contact 84 is brought into contact with the contact bar 52, the electrical circuit is closed thereby energizing the light bulbs 46. Closure of the switch is achieved by the rotation of the hoop member 12. As the hoop member is rotated, the centrifugal forces generated cause the weight 86 to bring and bear the contact 84 into contact with the contact bar 52 to thereby close the circuit. Furthermore, because of the weight 86 this contact is maintained until the rotation of the hoop member ceases.

As the light bulbs are energized, the light emitted therefrom is dissipated through the apertures 14 into the surrounding environment.

It should be noted with respect hereto, that when the power supply needs replacement, means for access 88 thereto (FIG. 1) can be provided. Such means generally comprise a rotatable section 90 formed in the outer wall 22. The section 90 is formed by severing the wall 22 in the configuration shown. The inherent resiliency of the wall permits the section 90 to be rotated away from the remainder of the wall. Upon rotation of the section 90, which is located proximate the power supply, access to the power supply is provided. This obviates the necessity of disassembling the hoop when changing or replacing the batteries.

In accordance with the present invention it is apparent that many modifications are completely amenable hereto. For example, in lieu of the apertures 14, the outer wall 22 can be transparent. Likewise, the light bulbs 46 can be of varying colors. Also, it is possible to construct the switch 76 and the contact bar 52 in a manner such that depending upon the amount of centrifugal force generated by the rotation of the toy, certain bulbs will be sequentially energized, i.e. the greater the centrifugal force the greater the number of energized light bulbs.

Furthermore, by forming the hoop member from separable wall sections it is possible to replace burnt out bulbs with facility.

Having, thus, described the invention what is claimed is:

1. A hoop toy, comprising:

a. a toroidal member having a hollow interior, the toroidal member comprising:

1. a first arcuate wall having a first flange and a second flange, the flanges being diametrically opposed and inwardly directed toward the radial center of the wall,
2. a second arcuate wall having a first flange and a second flange, the flanges being diametrically opposed and inwardly directed toward the radial center of the wall,
3. the first flanges and the second flanges being adapted to be in abutting engagement,
4. locking means associated with the flanges for interengaging the arcuate walls, the locking means comprising a plurality of apertures disposed around one of the first flanges and one of the second flanges and a plurality of projections disposed on the other of the first flanges and the other of the second flanges, the projections of the first flange being received by the apertures of the other first flange, the projections of the second flange being received by the apertures of the other second flange to interengage the arcuate walls, and b. means for emitting light disposed in the interior of the toroidal member, the light emitting means comprising a single source of power.

2. The toy of claim 1 wherein the toroidal member is provided with a plurality of apertures disposed therearound.

3. The toy of claim 1 wherein the means for emitting light further comprises:

a. illuminating means in electrical relationship with the source of power, and b. a normally open switch interposed between the source of power and the illuminating means.

4. The toy of claim 3 wherein the illuminating means comprises a plurality of light bulbs in electrical series relationship.

5. The toy of claim 3 wherein the switch is a centrifugal switch, the switch being closed in response to the application of centrifugal force thereonto.

6. The toy of claim 3 which further comprises:

means for access to the interior of the toroidal member to facilitate access to the source of power.

* * * * *